US005823683A

United States Patent [19]

Antonacci et al.

[11] Patent Number: 5,823,683

[45] Date of Patent: Oct. 20, 1998

[54] SELF-SEAMING PRODUCE BAG

[75] Inventors: Paul N. Antonacci, Atlanta; Craig R. Rusert, Dunwoody, both of Ga.

[73] Assignee: Amoco Corporation, Chicago, Ill.

[21] Appl. No.: 735,701

[22] Filed: Oct. 23, 1996

Related U.S. Application Data

[60] Provisional application No. 60/006,010 Oct. 23, 1995.

[51] Int. Cl.[6] ..... B65D 30/06

[52] U.S. Cl. ..... 383/107; 383/117; 383/37; 383/9; 428/36.1

[58] Field of Search ..... 383/117, 107, 383/9, 37; 428/36.1; 442/1

[56] References Cited

U.S. PATENT DOCUMENTS

| | | | |
|---|---|---|---|
| 1,872,640 | 8/1932 | Pink | 383/117 X |
| 2,085,365 | 6/1937 | Israel | 383/117 X |
| 3,257,915 | 6/1966 | Cartier et al. | 383/117 X |
| 3,554,368 | 1/1971 | Nagel | 383/117 X |
| 4,196,534 | 4/1980 | Shibamoto | 383/117 X |
| 4,207,983 | 6/1980 | Wolske | 383/117 X |
| 4,681,781 | 7/1987 | Murray et al. | 428/35 |
| 4,929,303 | 5/1990 | Sheth | 156/209 |
| 5,182,162 | 1/1993 | Andrusko | 428/219 |
| 5,244,724 | 9/1993 | Antonacci et al. | 428/288 |

FOREIGN PATENT DOCUMENTS

| | | | |
|---|---|---|---|
| 26 36 821 | 2/1978 | Germany | 383/117 |
| 00453359 | 2/1990 | Japan | 383/117 |

*Primary Examiner*—Jes F. Pascua
*Attorney, Agent, or Firm*—Stephen L. Hensley

[57] ABSTRACT

The present invention provides an improved produce bag comprising an open, mesh-like fabric suitable for processing on automated bagmaking equipment. The bag has a sealed end, an open end capable of being sealed after filling of the bag and a longitudinal, heat-sealed seam extending from end to end. An optional print band or label can be heat sealed to the bag to reinforce the longitudinal heat-sealed seam.

17 Claims, 3 Drawing Sheets

SELF-SEAMING PRODUCE BAG

This application claims the benefit under 35 U.S.C. 119(e) of provisional application Ser. No. 60/006,010, filed Oct. 23, 1995.

FIELD OF THE INVENTION

This invention relates to produce bags for transporting, both at a retail and wholesale level, perishable produce such as onions, grapefruits, oranges, potatoes, and the like. More particularly, the present invention relates to a produce bag manufactured from a flat mesh or net-like fabric which is self-sealing and thus can be used to form the seam of the bag without the need for stitching or adhesives.

BACKGROUND OF THE INVENTION

Heretofore, produce bags have in general either been made from solid plastic films, tubular packaging material, such as VEXAR originated by E.I. de Nemours and Company, tubular leno weave materials, or flat woven materials which require sewing of the longitudinal seam of the bag. Each of these approaches has its own difficulties. For example, the use of a tubular material requires investment in specialty equipment to use same (see, e.g., U.S. Pat. No. 4,091,595). Materials heretofore made from flat packaging materials, while avoiding the complexities associated with the use of tubular materials, have required a sewing step, and generally, nonwoven materials have heretofore proven unsatisfactory in such applications. Plastic films lack breathability; attempts to overcome this limitation, such as by perforation, add cost, can impair strength and generally do not perform satisfactorily.

Beyond traditional attributes of produce bags, including strength, breathability and sufficient transparency or openness to allow viewing of their contents, high speed and automated bagmaking and filling equipment have imposed additional requirements. To process well on high speed bagmaking equipment, fabric must track precisely through the equipment and remain in registration over the entire sequence of bagmaking steps. This can entail acceleration at 0.5 g to 5 g or higher as many as ten times during the bagmaking process. The fabric must remain precisely in registration through repeated accelerations and decelerations so that each step of the bagmaking operation, e.g., heat sealing, label application, wicketing, die cutting, finished bag cut-off, will be performed in precisely the right position on the bag. The fabric must also be heat sealable at the seam area and there must be sufficient seam strength that the bag has the integrity to withstand filling operations and transportation and handling. Dimensional stability of a bag's material of construction is important for such operations from the standpoint of maintaining registration and avoiding deformation as the material starts and stops during its progression through the bagmaking equipment. The bagmaking material also should have relatively low coefficient of friction and uniform profile so that it and the resulting bags can pass smoothly through bagmaking and filling machinery without snagging or bunching and will slide easily when discharged and stacked at the end of the bagmaking process.

Bags meeting the criteria for these operations and also having the more traditional attributes of conventional produce bags have not heretofore been available or known. Leno weave fabrics lack adequate dimensional stability and, for some products, are so rough that they can cause peeling or other damage to produce. These materials, as well as tubular mesh products such as the aforementioned Vexar, also exhibit too much friction for smooth operation of some equipment. Flat weave fabrics, when woven loosely enough to provide breathability and visibility, lack adequate dimensional stability.

SUMMARY OF THE INVENTION

Briefly, this invention provides a produce bag comprising an open mesh fabric that defines a product-receiving and -containing a space terminating at a closed butt end of the bag, with the fabric defining at an opposed end of the space an opening capable of being closed, with the bag having at least one heat-sealed, longitudinal seam extending from the butt end to the opening, and wherein the fabric is suitable for processing into bags using high speed bagmaking equipment. Preferably, the fabric has a coefficient of friction of less than 30° according to ASTM 3334-80, Section 15, and dimensional stability such that the fabric, when formed and longitudinally seamed into a tubular configuration, can withstand a force of at least about one g without substantial deregistration. In a specific embodiment, the invention relates to produce bags in which a longitudinal print band is sealed over the seam of the produce bag. The invention is advantageously made, for example, from cross-laminated nonwoven fabric available commercially in the United States from Amoco Nisseki CLAF, Inc. under the tradename CLAF®. Such fabrics are preferably made from coextruded films of high density polyethylene and low or linear low density polyethylene. The low or linear low density polyethylene, having a lower melting point than the high density polyethylene, provides a layer of material whereby the nonwoven fabric can be sealed to itself through the application of heat and pressure.

Importantly, the inventive produce bags can be manufactured with great ease on high speed bagmaking equipment, for example, automated bagmaking equipment provided by the Totani Company, with minor modification. In addition, the invented bags are well suited for use in automated bagfilling operations owing to their dimensional stability and ability to be wicketed. Significantly, these attributes are achieved without loss of other important produce bag features, including strength, flexibility, breathability and contents visibility.

BRIEF DESCRIPTION OF THE DRAWINGS

There are described hereinafter in detail certain nonlimiting embodiments of the invention with reference to the accompanying drawings in which.

DETAILED DESCRIPTION OF THE INVENTION

Figure 1:
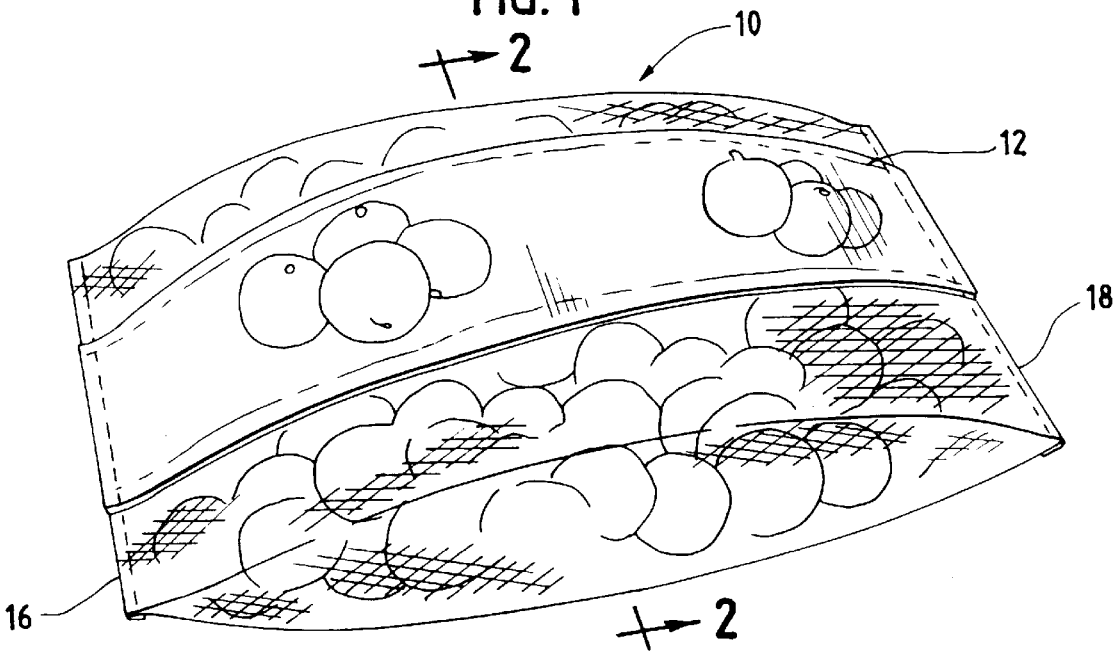
FIG. 1 is a perspective view of a produce bag according to the invention having a longitudinal print band heat-sealed over the longitudinal seam of the produce bag.

The produce bag of the present invention is formed from a flat fabric, preferably a nonwoven mesh-like material, most preferably a cross-laminated nonwoven fabric made from coextruded film that has been split and stretched. Such coextruded film can comprise, for example, a layer of high density polyethylene and a layer of low density polyethylene. In general, the invented bags can be constructed from any heat-sealable fabric suitable for processing into bags using high-speed bagmaking equipment and having an open or mesh-like construction. Preferably, the fabric's coefficient of friction is less than about 30° according to ASTM 3334 Section 15 and it has dimensional stability effective to withstand a force of at least one g without substantial deregistration. More preferably, the coefficient of friction is about 5° to about 30° and most preferably about 15° to about 25° to facilitate bagmaking and filling operations. Dimensional stability more preferably is such that the fabric can withstand g forces of at least 2, and most preferably at least about 3 g, without deregistration when formed and seamed into a tube.

A preferred form of mesh-like material for construction of the invented bags is a so-called "cross laminated airy fabric," also known by the Nippon Petrochemical Company Ltd. trademark CLAF®. This material can be characterized as a net-like web or nonwoven and is described in detail in commonly assigned U.S. Pat. No. 5,182,162 which is incorporated herein by reference. As described in that patent, such fabrics have a net-like structure comprising a multiplicity of aligned thermoplastic elements wherein a first segment of elements is aligned at about a 45° to about 90° angle to a second segment of the elements and the elements define a border for multiple void areas of the net-like nonwoven structures. The border which defines the void areas can be parallelogram-shaped such as a square, rectangle or diamond, or ellipse-shaped such as a circle or ellipse depending on the process of formation of the net-like web. The elements which define the border can be in the same plane or different planes. Elements in different planes can be laminated to each other. A preferred thermoplastic net-like web is a "cross-laminated thermoplastic net-like web" having a uniaxially oriented thermoplastic net or web laminated to a second oriented net or web of a thermoplastic such that the angle between the direction of orientation of each film is about 45° to about 90°. The webs can have continuous or discontinuous slits to form the void areas of the net-like web and can be formed by any suitable slitting or fibrillation process. The net-like structure can also be formed by other means such as forming on one side of a thermoplastic film a plurality of parallel continuous main ribs and forming on the opposite side of the film a plurality of parallel discontinuous ribs with the film being drawn in one or two directions to open the film into a network structure, punching or stamping out material from a film to form a pattern of holes in the film and stretching the film to elongate the spaces between the holes. The net-like structure can also be formed by extrusion with the net being oriented by a stretching operation.

The thermoplastic net-like webs are made from film forming materials made into film which, for cross-laminated thermoplastic net-like webs, are oriented, slit and laminated together. Among the film forming materials which can be employed in making the cross-laminated thermoplastic net-like webs are thermoplastic synthetic polymers of polyolefins such as low density polyethylene, linear low density polyethylene, polypropylene, high density polyethylene, random copolymers of ethylene and propylene and combinations of these polymers; polyesters; polyamides; polyvinyl polymers such as polyvinylalcohol, polyvinylchloride, polyvinylacetate, polyvinylidenechloride and copolymers of the monomers of these polymers. Preferred materials are polyesters and polyolefins such as polypropylene, random copolymers of propylene and ethylene, and a combination of high density polyethylene and low density polyethylene.

These thermoplastic synthetic polymers may contain additives such as stabilizers, plasticizers, dyes, pigments, anti-slip agents, and foaming materials for foamed films and the like.

The thermoplastic material can be formed into a film by extrusion, coextrusion, casting, blowing or other film-forming methods. The thickness of the film can be any workable thickness with a typical thickness in the range of about 0.3 to about 20 mil. Coextruded films can be used containing two or more layers of thermoplastic material such as a layer of polypropylene and a layer of low density polyethylene wherein one layer can have about 5 to about 95% of the thickness and the second layer the remaining thickness. Such coextruded structures most preferably are formed from first and second thermoplastic resin compositions wherein the first composition is a higher melting point resin that provides strength or load-bearing capability to the fabric and the second composition is a lower melting point resin that has good adhesion to the first composition to thereby provide heat sealability to the fabric.

Another type of coextruded film construction has a three-layer construction wherein each of the three layers can be a different thermoplastic polymer. More often however, the three-layer coextruded film is made with the same material for the exterior two layers and a different polymer for the interior layer. The interior layer can occupy about 5 to about 95% of the film thickness and typically ranges from about 50 to about 80% of the thickness with the outer two layers making up about 20 to about 50% of the thickness with the outer two layers typically having about equal thickness. Coextruded films are typically used for making cross-laminated thermoplastic net-like webs in which one layer of film is cross-laminated (and bonded to a second layer of film with the exterior layers of the films containing compatible and easily bondable thermoplastic materials) such as low density polyethylene or linear low density polyethylene.

The film can be oriented by any suitable orientation process with typical stretch ratios of about 1.5 to about 15 dependent upon factors such as he thermoplastic used and the like. The temperature range for orienting the film and the speed at which the film is oriented are interrelated and dependent upon the thermoplastic used to make the film and other process parameters such as the stretch ratio.

Cross-laminated thermoplastic net-like webs can be made by bonding two or more layers of uniaxially oriented network structure films together wherein the angle between the direction of uniaxial orientation of the oriented films is between about 45° to about 90° in order to obtain good strength and tear resistance properties in more than one direction. The orientation and/or formation of the network structure in the films can be completed before the bonding operation or it can be done during the bonding process. Bonding of two or more layers of network structure films can be made by applying an adhesive between the layers and passing the layers through a heating chamber and calender rolls to bond the layers together, or by passing the layers through heated calender rolls to thermally bond the layers together, or by using ultrasonic bonding, spot bonding or any other suitable bonding technique.

As described in U. S. Pat. No. 4,929,303, the cross-laminated net-like webs can be nonwoven cross-laminated fibrillated film fabrics as described in U.S. Pat. No. 4,681, 781. The cross-laminated fibrillated films are disclosed as high density polyethylene (HDPE) films having outer layers of ethylene-vinyl acetate coextruded on either side of the HDPE or heat seal layers. The films are fibrillated, and the resulting filament-like elements are spread in at least two transverse directions at a strand count of about 6–10 per inch. The spread fibers are then cross-laminated by application of heat to produce a non-woven fabric of 3–5 mils thickness with about equal machine direction and transverse direction strength properties well suited for thin, open mesh fabrics of exceptional strength and durability. As disclosed in U.S. Pat. No. 4,929,303, the open mesh fabric can be laminated to material such as paper, film, foil, foam and other materials by lamination and extrusion coating techniques, or by sewing or heat sealing, adding significantly to the strength of the reinforced material without adding substantial bulk. The fabric may be of any suitable material, but is preferably low density polyethylene, linear low density polyethylene, polypropylene, blends of these polymers' and polyesters. The open mesh fabrics generally have an elongation (ASTM D1682) less than about 30%; an Elmendorf tear strength (ASTM D689) of at least about 300 g; and a breakload (ASTM D1682) of at least about 15 lb/in. Reported uses of cross-laminated fibrillated film fabrics include shipping sacks for cement, fertilizer and resins, shopping, beach and tote bags, consumer and industrial packaging such as envelopes, form, fill and seal pouches, and tape backing, disposable clothing and sheeting, construction film and wraps, insulation backing, and reinforcement for reflective sheeting, tarpaulins, tent floors and geotextiles, and agricultural ground covers, insulation and shade cloth.

Cross-laminated thermoplastic net-like webs are available from Amoco-Nisseki CLAF, Inc. under the designation of CLAF® with examples of product designations including CLAF S, CLAF SS, CLAF SSS, CLAF HS and CLAF MS. Such fabrics are available in various styles and weights, and it has been determined that the style HS is a suitable fabric for the application contemplated by the present invention. HS style CLAF® has a basis weight of roughly one ounce per square yard, and a thickness of approximately 7.8 mils, all as determined by ASTM D3776 and ASTM D1777, respectively. Inherent properties of such fabrics that make them well suited materials of construction for the invented bags include coefficient of friction of about 20° and dimensional stability sufficient to withstand acceleration of at least about 3 g without significant deregistration. As an indicator of such dimensional stability, grab tensile testing according to ASTM 5034-95 with test specimens cut at a 45° angle to the fabric machine direction can be used, with loads at 10% elongation of about 2.5 pounds characterizing the fabrics. Other typical properties of this fabric include machine direction grab tensile strength of about 35 pounds and elongation of about 15% according to ASTM 5034-95.

Other CLAF® fabrics and net-like webs may be used depending upon the size of the bag and its application. Other woven, knit, scrim and nonwoven fabrics may also potentially be used provided the fabric is constructed of a self-seaming material, normally a bicomponent synthetic material in which one component has a lower melting temperature or softening point than the other component and that the fabric has a coefficient of friction according to ASTM 3334-80 Section 15 of less than about 30° and dimensional stability such that the fabrics when formed and longitudinally seamed into a tubular configuration can withstand g forces of at least about 1. Grab strengths with the fabric cut at 45° to the machine direction such that loads at 10% elongation are at least about 0.5 pound, and preferably about 1 to about 50 pounds are indicative of suitable dimensional stabilities.

Woven and knit fabrics can be prepared from any suitable yarns; however, from a cost and performance standpoint, so-called tapes or slit-film ribbon yarns are preferred. Any suitable weave providing an appropriate level of breathability of the fabric and visibility of a bag's contents can be utilized. Leno weaves have traditionally been utilized for produce bags but typically have excessive coefficients of friction for use in the present invention unless additional steps such as application of friction resisting coatings or heat sealing of the fabric is conducted to provide the fabric with lower surface friction. Flat weave fabrics also can be employed, although these may or may not exhibit suitable coefficients of friction, and can be coated or otherwise treated to reduce friction. In any event, coating or heat sealing of such fabrics is necessary to provide adequate dimensional stability and fray resistance to the same. Of course any such coating must be applied to the fabric in a discontinuous manner, that is, so that less than the entire surface of the fabric is coated, in order to ensure that the coated fabrics have adequate breathability. Various techniques for discontinuous coating of fabrics are well-known. An example is stripe coating as disclosed in U.S. Pat. No. 4,557,958. Heat sealing also can be utilized to improve dimensional stability of such fabrics, as will be appreciated by persons skilled in the art. In the case of these woven fabrics, whether a leno weave, flat weave or otherwise, the yarns of the fabric or such yarns and any coatings will generally comprise at least two thermoplastic resin compositions or formulations having different melting points, with a higher melting resin being present to provide strength and integrity to the fabric and a lower melting resin being present, either as a discontinuous coating on the surface of the fabric or laminated to or as part of the yarns thereof, e.g., as coextruded tapes, to provide for heat bonding of the yarns of the fabric to one another and, in turn, dimensional stability and resistance to fraying. Like considerations are applicable to knit fabrics and scrims.

Whether the fabric is a woven, knit or scrim material or a nonwoven, preferred thermoplastic resins therefor are polyolefins such as polypropylene, polyethylene and copolymers of propylene and polyethylene. High, medium, low and linear low density polyethylenes are contemplated. Preferred combinations of resins are polypropylene for strength or load-bearing components of the fabric and polyethylene or blends thereof with polypropylene for the heat sealable components thereof and high density polyethylene for the strength or load-bearing components and low density polyethylene for the heat-sealing components.

The invented bags can be manufactured by any suitable technique but are particularly suited for manufacture using high speed or automated bag-forming equipment, such as that available from Totani. The Totani Model FD-35V Tuber, for example, is suitable in the manufacture of the bags of the present invention when equipped with a print band sealer. Such sealing means and equipment are well known to those of ordinary skill in the art and the selection of such is dependent on the exercise of sound engineering judgment, to be exercised with a knowledge of the present disclosure combined with a knowledge of the properties of the fabrics to be employed. Generally, the bags are made by cutting fabric to desired width, folding and forming the fabric, heat-sealing to form a longitudinal seam, heat-sealing or stitching an end and, if used, applying a print band or label. Preferably, such labels are heat sealed to the fabric.

Figure 2:
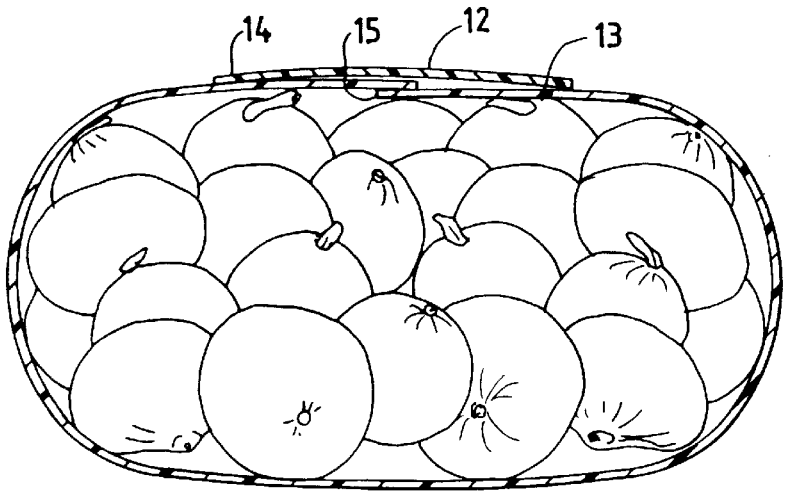
FIG. 2 is a cross-sectional view of the produce bag of FIG. 1.
Figure 9:
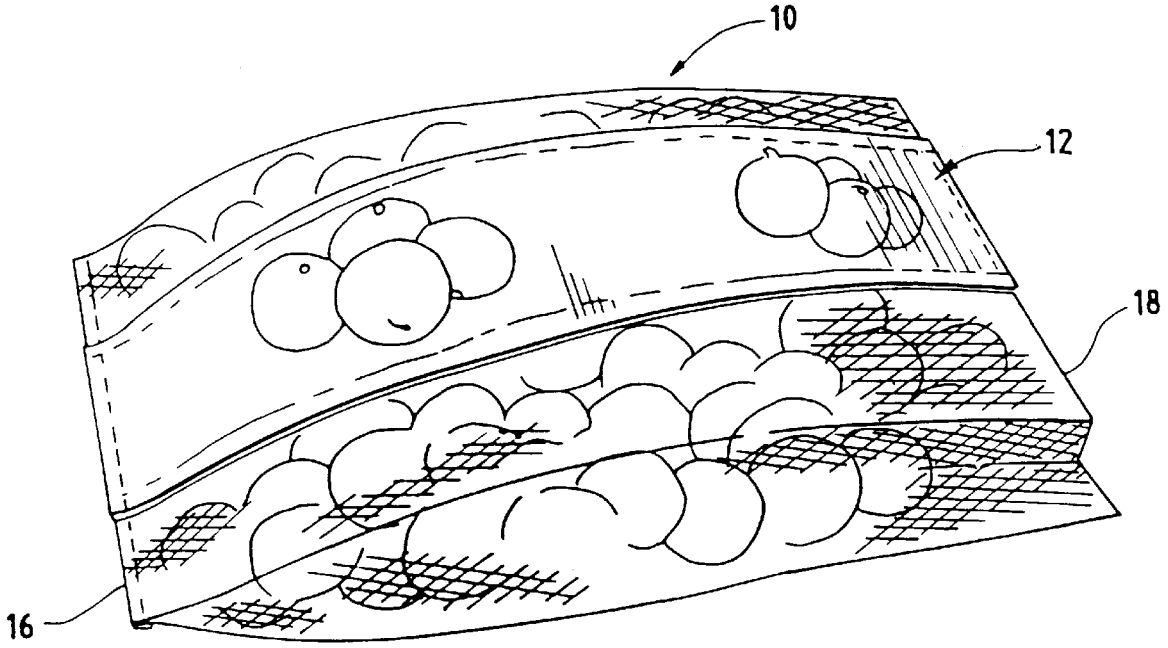
FIG. 9 is a perspective view of the bag of FIG. 1 illustrating the open end of the bag.

Referring now to FIG. 1, a produce bag 10 is shown. The bag is constructed of an open, mesh-like fabric that defines a product-containing space. The bag has a print band or label 12 which runs longitudinally the length of the bag between ends 16 and 18. As shown in this embodiment of the invention, the ends of the bags 16 and 18 are sewn by conventional means. Alternatively, one having the benefit of this disclosure would appreciate that the ends of the bag may also be heat-sealed in the self-sealing manner as will be described hereinafter with reference to the longitudinal seam of the produce bag. FIG. 9 illustrates produce bag 10 having end 18 open. FIG. 2 shows in greater detail the construction of this first embodiment of the invention. In particular, the print band 12 can be seen as having two heat seals on either side, 13 and 14. The print band may conveniently be made from printable polymeric films available commercially such as three layer composite of, for example, a high density polyethylene/linear low density polyethylene/blend of high density polyethylene and ethylene-vinyl acetate. Such films are available, for example, from Winpak Inc., in 2 and 3 mil thicknesses. Similarly, the print band may be made from a film comprising linear low density polyethylenelpolyester or from oriented polypropylene film coated with low or linear low density polyethylene. A label made from 1.25 mil linear low density polyethylene and 0.5 mil polyester has been found to have acceptable performance properties in this application. Depending on economics, a film of linear low density polyethylene only can also be used, although the printablility of such film is not as good as that as some of the composite films.

The heat sealed portions 13 and 14 of the print band can be as wide as necessary to effectively bond the print band to the produce bag and thereby reinforce the lap seam 15. In general, seam widths of between ½ inch and 2 inches are generally preferred in this embodiment of the invention, and a seam width of 1 inch is, depending again on the size of the bag and its application, most preferred. As further shown in FIG. 2, the print band 12 reinforces the lap seam 15. Lap seam 15 may be of a dimension suitable for the given application but in general, for produce bag applications, it has been found that a lap seam in the range of ¼ to 1 inch, and preferably ½ inch is desirable.

In forming the lap seam 15 and heat sealed portions 13 and 14 of the print band 12, the heat seals may be formed using any heat seal means known in the art, including for example a seal bar. The seal bar temperature will be at a temperature which is dependent upon the style and composition of the material chosen and other variables, but in general, a seal bar temperature of between 200° and 350° F., a pressure of between 30 and 75 psi, and a dwell time of between 0.2 and 2 seconds are required to form a substantial seam when CLAF style fabric is used for the bag material.

While the bag illustrated in FIGS. 1 and 2 represents a preferred construction for some end uses, it will be appreciated that a wide range of modifications and alternatives to that construction are contemplated according to the invention. Thus, while the heat-sealed seam in the figures is shown at approximately the midpoint of the width of the bag, the seam can be located closer or farther from a side edge of the bag, or even at a side edge, as may be desired or necessary to accommodate the bagmaking equipment or particular print band or label configurations. In another alternative embodiment, the open mesh fabric at the open, sealable end of the bag can be somewhat shorter on one side of the bag than the other to facilitate use of the bags in automated filling operations; this also can facilitate closing of the open end of the bag because the additional fabric from the longer side of the bag provides a convenient flap that can simply be folded over onto the shorter side and heat-sealed, stitched or otherwise sealed to form an effective closure for the bag. In yet another embodiment, gussets can be incorporated into the final bag structure such as by folding during forming of the bags.

Figure 3:
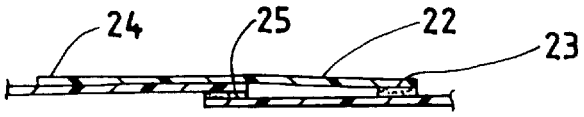
FIGS. 3–8 are cross-sectional views of various alternative embodiments of the invention, in particular with regard to the formation of the seam of the bag.
Figure 4:
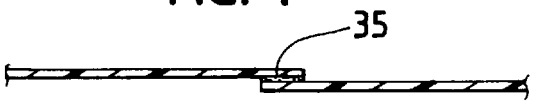

Referring now to FIGS. 3–8, other alternative embodiments of the present invention, and in particular, in the construction of the longitudinal seam of the produce bag, are shown. FIG. 3 demonstrates generally the construction used in the manufacture of the produce bag of FIG. 1 in which a print band 22 is used in overlapping relationship to the lap seam 25. Alternatively, as shown in FIG. 4, the produce bag may be constructed without any print band whatsoever, in which case the lap seam 35 is used to provide the integrity to the bag required for this application.

Figure 5:
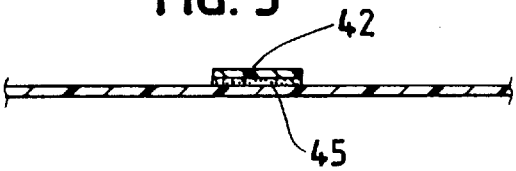

FIG. 5 shows yet another alternative embodiment of the present invention. In this embodiment a seaming tape 42, which may be made of material similar or identical to those used in print bands, is heat-sealed across its length in overlapping relationship to the butt joint 45 formed by the edges of the nonwoven fabric.

Figure 6:
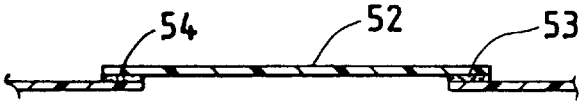

In FIG. 6, it can be seen that yet another alternative embodiment of the invention is to use the print band 52 to span a gap between the edges of the nonwoven fabric material. In this case the print band itself provides the integrity necessary to hold together the edges of the produce bag at the seam. Heat seals 53 and 54 are used to operatively connect the print band to the nonwoven fabric material.

Figure 7:
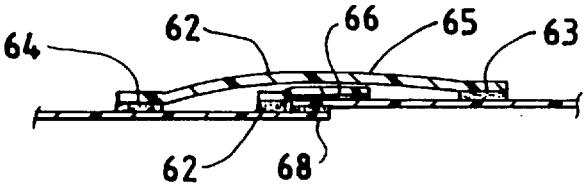

FIG. 7 shows yet another alternative embodiment of the invention. In this embodiment, the print band 62 overlaps a seam which comprises a seaming tape 65 that is heat sealed along edges 66 and 67 to the nonwoven fabric material, which is itself lap seamed 68. Such a construction can be employed where extra strength is required at the seam of the bag.

Figure 8:
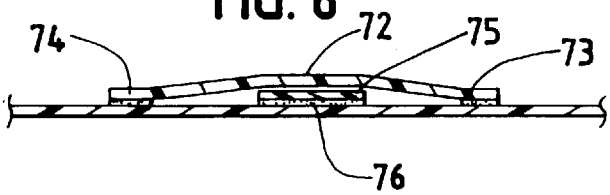

FIG. 8 shows yet another alternative embodiment of the present invention, in which the print band 72 is used to reinforce the seam formed by tape seam 75 which is heat welded across its width over butt joint 76.

Figure 10:
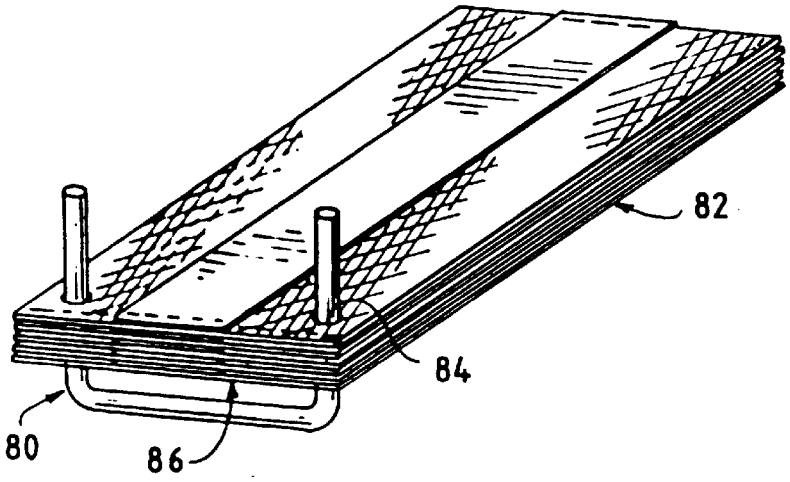
FIG. 10 illustrates a plurality of bags disposed on a wicket.

According to another embodiment of the invention, the invented bags can be provided in the form of a stack made up of a plurality of bags disposed on a wicket. The wicket generally is in the form of a wire or rod having two right angle bends and adapted to receive and hold in place the bags by means of holes punched or otherwise made in the sealed end of the bags. This embodiment is illustrated in FIG. 10, showing wicket 80, a stack of bags 82 and holes 84 in the sealed ends 86 of the bags. Advantageously, the dimensional stability of the bag fabric aids in maintaining the holes in registration and also prevents fraying of the fabric due to the holes.

EXAMPLES

The following examples illustrate the invention but are not intended to limit it. A series of 10-pound produce bags were made using the seam construction identified in FIGS. 1 and 2. The bag material was DWW (double warp web) HS CLAF® fabric supplied by Amoco Fabrics and Fibers Company. In Examples 1 and 2, the print band material chosen was a film of high density polyethylene/linear low density polyethylene/blend of low density polyethylene and ethylene-vinyl acetate. In Example 1 the print band film was 2 mils in thickness and in Example 2 the print band material was 3 mils in thickness. These print band materials were obtained from Winpak, Inc. In Example 3, the print band was constructed of a film composite of 48 gauge PET/1.25 mil linear low density polyethylene film. In all examples the bags were made using a Totani FD-35V bag forming machine operating at speeds of 90 to 123 bags/minute. Longitudinal seams were formed using print bars operated at temperatures of between 300° and 320° F. The bags were then subjected to a series of tests.

One test to which the bags were subjected is the so-called drop test. In this test, each bag was filled with 10 pounds of onions. The bag was then dropped from a height of 3 feet to a hard surface. In the first three drops, the bag is dropped on its butt end. In drops 4 and 5 the bag is dropped on its face or label side; in drops 6 and 7 the bag is dropped on its side. Drops 8 and higher are all performed by dropping the bag on its butt end.

In the bag of Example 1, the bag required 12 drops to failure. Failure occurred by a tear in the nonwoven fabric itself rather than in the seam. In the bags made in Example 2, the number of drops to failure varied from 11 to 28 drops. In all cases, the produce bag failed by virtue of a tear in the fabric next to the seam itself, but not by a failure of the seam. In the case of Example 3, an atypical failure occurred in one bag after a first drop; in this drop the fabric tore but the seam did not fail. In other bags considered to be more typical of Example 3, the bags failed after between 9 and 27 drops. In all cases, the bag failed due to a tear in the nonwoven fabric itself rather than in the seam; in the case of the highest number of drops to failure, the fabric tore adjacent to the seam.

In the second battery of tests, the bags of Examples 1–3 were subjected to tensile testing pursuant to ASTM D-1682. Tensile tests specimens 1 inch in width were cut from the bags across the seam, with the direction of testing being perpendicular to the seam. Tests were performed on seams having a print band label only, with a lap seam only, and with both a lap seam and print band.

For the bags of Example 1, the test of the lap seam only yielded a strength of 16 pounds per inch; the label only yielded a strength of 5.5 pounds per inch; and the test of the seam and label together produced a strength of 19.8 pounds per inch. In Example 2, the respective data are 14.6 pounds per inch; 7.7 pounds per inch; and 20.7 pounds per inch. In Example 3, the data are 16.2 pounds per inch; 13.8 pounds per inch; and 18.5 pounds per inch. In the case of the data from each of these Examples where the print band only was tested, failure occurred in the print band material itself; no separation from the nonwoven CLAF® fabric was detected.

From the above data, it will be appreciated that the print label in fact improves the strength of the seam. These data will also be recognized by those of ordinary skill in this art as showing significant strength in the seam portion of the produce bag.

With respect to the bagmaking operation, with the machinery operating at 120 bags per minute in the production of 18 inch long bags, which is typical for 5 pound produce bags, the average fabric speed through the equipment is about 180 feet per minute. However, the fabric is stationary for at least half of the time it is on the equipment because operations including die cutting, bag cutout and precision heat sealing take place. Accordingly, average speed of the fabric while it is actually in motion is estimated to be on the order of 360 feet per minute, with maximum speeds estimated at over 700 feet per minute. At 120 cycles per minute and a 50% rest time through the machine, some aspects of the operation involve acceleration of the fabric from 0 to about 720 feet per minute and deceleration back to 0 feet per minute in times as short as one-quarter second (assuming constant rates of acceleration and deceleration). Thus, accelerations of 96 feet per second$^2$, or about 3 g, are frequently encountered and actual accelerations can be 5 g or higher. Typical accelerations utilizing the Totani Model FD-35V Tuber range from about 4 to about 5 g.

We claim:

1. A produce bag comprising an open mesh fabric that defines a product-receiving and -containing space terminating at a closed, butt end of the bag, with the fabric defining at an opposed end of the space an open end capable of being closed, said bag having the fabric heat sealed to itself to form at least one longitudinal seam extending from the butt end to the opening, and wherein the fabric is heat sealable to itself and has a coefficient of friction according to ASTM 3334-80 Section 15 of less than about 30° and a Grab Strength according to ASTM 5034-95 with the fabric cut at a 45° angle to a machine direction thereof such that load at 10% elongation is at least about 0.5 pound.

2. The produce bag of claim 1 wherein the fabric comprises a cross-laminated nonwoven fabric comprising a layer of higher melting thermoplastic resin laminated to a layer of lower melting thermoplastic resin.

3. The produce bag of claim 1 wherein the fabric comprises an open weave fabric woven from tapes comprising a layer of higher melting thermoplastic resin laminated to a layer of lower melting thermoplastic resin.

4. The produce bag of claim 3 wherein the fabric comprises an open weave fabric woven from tapes comprising a higher melting thermoplastic resin, said open weave fabric having a discontinuous coating of lower melting thermoplastic resin.

5. The produce bag of claim 1 wherein a label is affixed to the fabric.

6. The produce bag of claim 5 wherein the label is affixed to the fabric on both sides of the longitudinal seam.

7. The produce bag of claim 6 wherein the label is affixed to the fabric by heat sealing.

8. A plurality of bags according to claim 1 disposed on a wicket.

9. The produce bag of claim 1 wherein the closed end of the bag is stitched.

10. The produce bag of claim 1 wherein the closed end of the bag is heat sealed.

11. The produce bag of claim 1 wherein the opening capable of being sealed is sealed.

12. The produce bag of claim 1 wherein the fabric has a coefficient of friction of about 15° to about 25°.

13. The produce bag of claim 1 wherein the fabric has a Grab strength with the fabric cut at a 45° angle to a machine direction thereof such that load at 10% elongation is about 1 to about 50 pounds.

14. The produce bag of claim 13 wherein the fabric has a coefficient of friction of about 15° to about 25°.

15. The produce bag of claim 14 wherein the longitudinal seam is a lap seam.

16. The produce bag of claim 15 wherein the lap seam has a width of about ¼ to about 1 inch.

17. The produce bag of claim 16 wherein a label is affixed to the fabric on both sides of the longitudinal seam.

* * * * *